US006591790B2

(12) United States Patent
Inoue et al.

(10) Patent No.: US 6,591,790 B2
(45) Date of Patent: Jul. 15, 2003

(54) FIRE-RESISTANT STRUCTURAL BODY SUPPORTING METAL BAR FOR PROTECTION OF WATER PIPE

(75) Inventors: Keita Inoue, Nokohama (JP); Ryuta Maruyama, Nokohama (JP); Minoru Ike, Nokohama (JP); Kenshi Yoshida, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/926,048

(22) PCT Filed: Dec. 20, 2000

(86) PCT No.: PCT/JP00/09022

§ 371 (c)(1),
(2), (4) Date: Oct. 22, 2001

(87) PCT Pub. No.: WO01/46621

PCT Pub. Date: Jun. 28, 2001

(65) Prior Publication Data

US 2003/0033990 A1 Feb. 20, 2003

(30) Foreign Application Priority Data

Dec. 21, 1999 (JP) ..... 11-363073

(51) Int. Cl.[7] ..... F22B 37/10

(52) U.S. Cl. ..... 122/512; 122/6 A; 122/511; 122/DIG. 13

(58) Field of Search ..... 122/6 A, 510, 122/511, 512, DIG. 13

(56) References Cited

U.S. PATENT DOCUMENTS 3,558,851 A * 1/1971 Oku ..... 219/146.3
3,828,735 A * 8/1974 Graham et al. ..... 110/336
3,838,665 A * 10/1974 Astrom ..... 110/336
4,768,447 A * 9/1988 Roumeguere ..... 110/325
4,966,100 A * 10/1990 Fournier et al. ..... 122/6 A
5,243,801 A * 9/1993 Aiken et al. ..... 122/6 A
5,845,610 A * 12/1998 Hatta et al. ..... 122/510
6,012,401 A * 1/2000 Orita et al. ..... 110/323
6,267,066 B1 * 7/2001 Schickling et al. ..... 110/324

FOREIGN PATENT DOCUMENTS

EP 0947775 A2 * 3/1999
WO WO 98/05901 2/1998

* cited by examiner

*Primary Examiner*—Jiping Lu
(74) *Attorney, Agent, or Firm*—Oblon, Spivak, McClelland, Maier & Neustadt, P.C.

(57) ABSTRACT

A support fitting for the heat-resistant block to protect boiler tubes, which protrudes upward at a right angle from the surface of the rib between two boiler tubes, and which is welded on the rib and has a catch to engage with the heat-resistant block on the end. The support fitting is provided with a welding surface to be welded on the rib and shaped narrower by chamfering, and a single globule of a deoxidizing conductive material used as flux is attached to the narrowed welding surface, and is a vertical piece or rod which extends a fixed distance perpendicular from the rib. The support fitting includes a first upper surface being kept horizontal to support a ferrule, which can tightly engage with the ferrule for arc stud welding, thereby the ferrule can shield the welding surface, and a second upper surface which engages with the heat-resistant block.

5 Claims, 6 Drawing Sheets

Fig. 4 (A) BACKGROUND ART
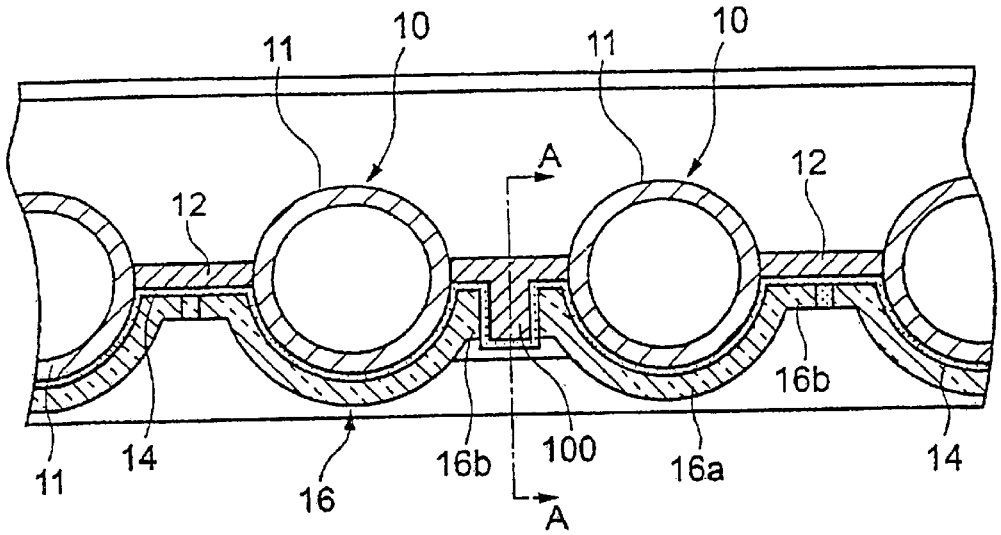
Fig. 4 (B)
BACKGROUND ART
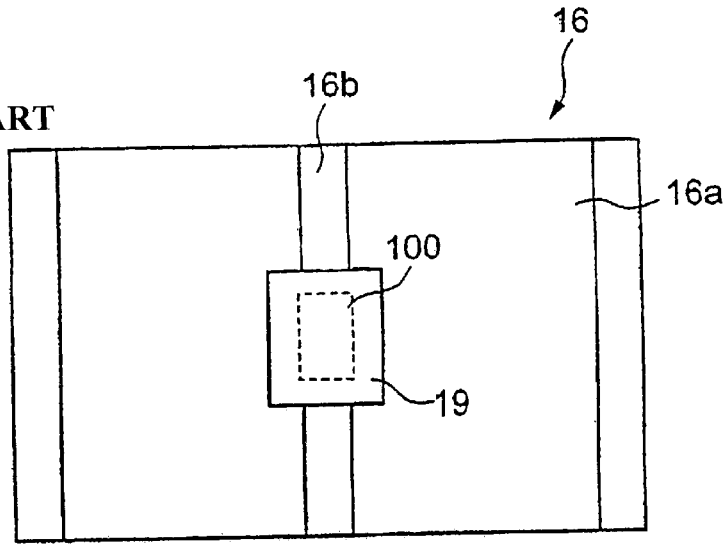

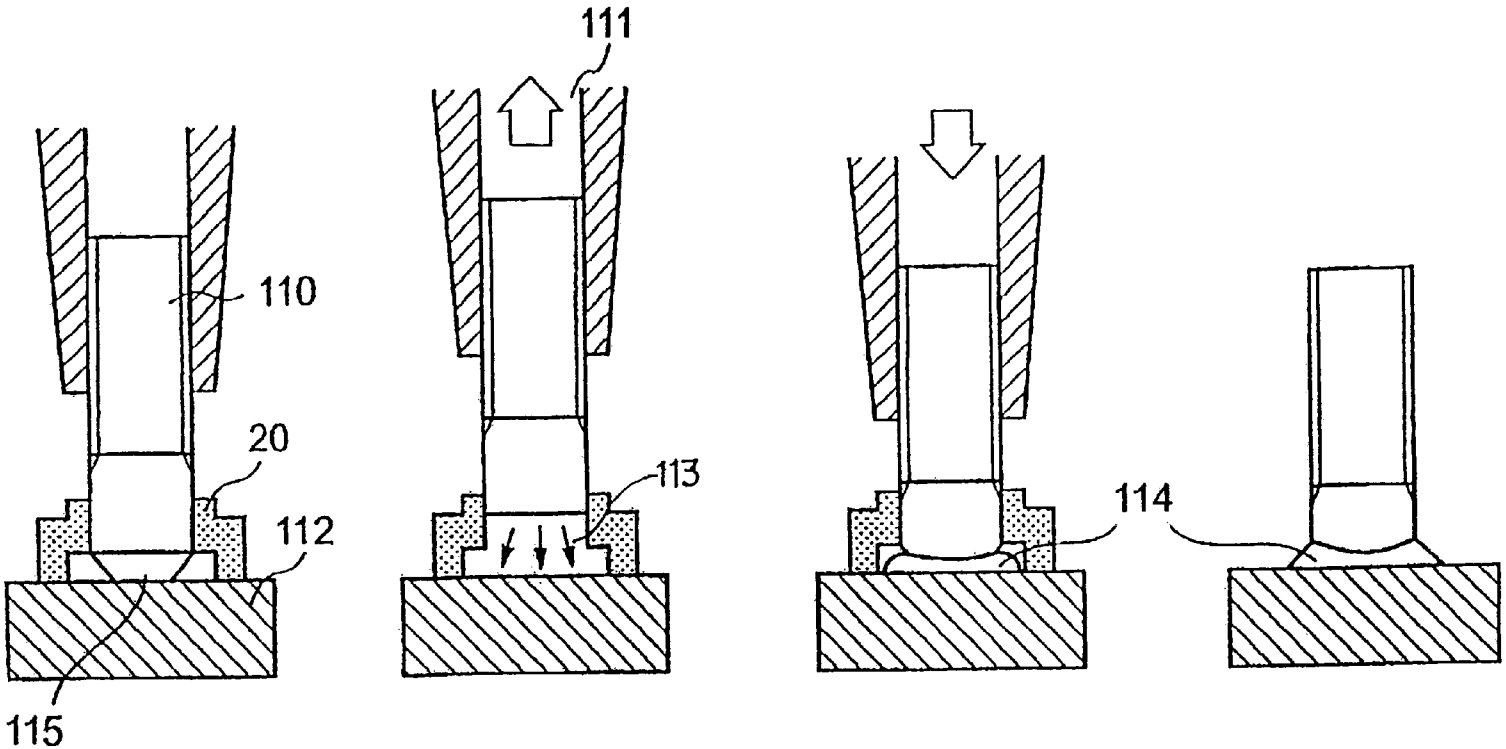
Fig. 6 (A) BACKGROUND ART
Fig. 6 (B) BACKGROUND ART
Fig. 6 (C) BACKGROUND ART
Fig. 6 (D) BACKGROUND ART

FIRE-RESISTANT STRUCTURAL BODY SUPPORTING METAL BAR FOR PROTECTION OF WATER PIPE

TECHNICAL FIELD

This invention concerns support fittings for supporting a heat-resistant assembly to protect boiler tubes which is mounted on an array of tubes belonging to a heat exchanger (or boiler) of a heat recovery boiler in a waste incinerator or a thermal power plant. More specifically, it concerns the support fittings for supporting a heat-resistant assembly to protect boiler tubes. The heat-resistant assembly is used on the heating side of the tubes facing the incinerator to protect the array of boiler tubes which constitute the plant's heat exchanger (i.e., boiler). This invention also concerns the array of boiler tubes on which the fittings are used.

TECHNICAL BACKGROUND

FIGS. 4 and 5 show a combined structure of boiler tubes and heat-resistant assembly. 10 is an array of boiler tubes in a heat-recovery boiler. A number of cylindrical tubes which constitute boiler tubes 11 are arranged in parallel. Each two of the cylindrical tubes are fixed in place by the flat rib 12. In the center of each of the ribs 12 is welded a support fitting 100, which is oriented vertically.

Support fittings 100 consist of a parallelogram with a vertical surface 100*a*, which is welded to flat rib 12, and an oblique upper surface 100*b*, which will engage in a heat-resistant catch 19. Generally, the vertical surface 100*a* is first placed in contact with the flat rib 12, and then side foot portion 100*c* is welded by hand. 16 is the heat-resistant block. The tube assembly 10, consisting of the boiler tubes 11 and the flat ribs 12, must be protected from the heat and corrosive atmosphere of the exhaust gases from combustion. As can be seen in FIG. 4, tube assembly 10 is enclosed in such a way that a 180° portion on the bottom of each tube is entirely covered. Each two lead tubes, paired in the axial direction, are protected by a block whose cross section resembles two semicircular tubes joined by a flat rib surface 16*b*. This block extends for a given length along the longitudinal axis of the tubes. The block surrounds boiler tube assembly 10 and is fitted close to but not directly against it, with a specified gap left between the block and the tube assembly.

19 is a heat-resistant catch by which the heat-resistant block 16 is attached through the support fitting 100 to boiler tube assembly 10 in such a way as to be integral with the assembly. It is a rectangular projection from the surface of flat rib 16*b* in the heat-resistant block 16. To insure that it has sufficient strength in the axial direction, the heat-resistant catch 19 should be no more than one third of the length of heat-resistant block 16. The catch can be attached to the heat-resistant block in not only one place, but more than two places.

The heat-resistant block 16 and the heat-resistant catch 19 are formed by molding a material like SiC which has relatively good thermal conductivity.

A thin layer of mortar 14 is packed on the inner side of the heat-resistant block 16 and the catch 19 to enhance the cooling effect of the block 16.

The boiler tube assembly 10 and the heat-resistant block 16 configured as described can be securely joined by means of support fitting 100 and heat-resistant catch 19. According to the prior art, the support fitting 100 was hand-welded to the flat rib 12 which connects two boiler tubes 11.

Because there are normally two semicircular boiler tube sections 11 in the location where the two facing surfaces must be hand-welded, the space into which the welding jig must be inserted is very small. In other words, the surfaces of the two boiler tube sections 11 interfere with the welding, making the welding task difficult and extremely time-consuming.

We therefore investigated the possibility of employing the comparatively simple procedure of stud welding instead of the hand welding. However, with both the arc and percussion stud welding, there were problems due to the non-rectangle shape of the support fitting 100 which made stud welding very difficult to perform.

Furthermore, the support fitting 100 does not have a round cross section like the stud bolt used in the prior art, but is tall and thin. It is difficult to achieve either the pressure or the temperature needed to weld it properly. When the long narrow fittings are to be stud-welded, they are frequently arc stud welded using a ferrule. To maintain the temperature for two-surface arc welding, a heat-resistant porcelain ferrule must be put on the end of the stud, and the welding must be executed while the periphery of the stud is covered by the ferrule.

The principle of arc stud welding using a ferrule can be explained simply with reference to FIG. 6. Ferrule 20 is placed on the end of stud 110. The end of stud 110 is placed in direct contact with a base metal. When the welder pulls the trigger of the welding electrode, a current flows between the stud 110 and the base metal 112.

The lifting mechanism 111 of the welding electrode automatically pulls up the stud 110. Inside the ferrule 20, an arc 113 is generated between the stud 110 and the base metal 112 as indicated by the arrows. The arc 113 is maintained for a period determined by a timer. The stud 110 and the base metal 112 fuse, and after a given period of time, the stud 110 is pressed against the base metal 112 and the current is cut off.

With this technology, then, a deoxidizing conductive material 115 as flux which is attached to the end of stud 110 by various methods acts on the metals in such a way as to result in a welded portion 114. The ferrule 20 mainly serves as a mold for the molten metals. When the welding is completed, it is removed as needed by a means such as breaking it.

However, when the support fitting 100 is welded by arc stud welding using a ferrule, the ferrule 20 cannot completely seal the welding surfaces of the materials as shown in FIG. 5(B), so it cannot serve as a mold.

Since support fitting 100 is to engage with the heat-resistant catch 19, it must have a stopper on its upper surface. This is why the surface which is to engage with the catch 19 slants upward. When the ferrule 20 is inserted onto the support fitting, as can be seen in FIG. 5(B), the upper surface of the fitting 100 is not perpendicular to the welding surface of the base metal (i.e., it is not horizontal). The ferrule 20, will be also oriented obliquely, so that its lower portion is not flush against the welding surface, making it difficult to maintain a uniform temperature.

Because the fitting 100 is long and narrow, it will be extremely difficult to insure that its contact with the base metal at the welding surface is uniform. If the arc is started from the lower end or the upper end where a considerable contact pressure is provided, a lopsided weld may result.

SUMMARY OF THE INVENTION

In view of the problems described above, the objective of this invention is to provide a support fitting for a heat-resistant block to protect boiler tubes which can be easily and reliably stud-welded without losing any of its function as a support fitting.

This invention concerns a support fitting for the heat-resistant block to protect boiler tubes, which protrudes upward at a right angle from the surface of the rib between two boiler tubes. The support fitting is welded on the rib and it has a catch to engage with the heat-resistant block on its end.

The support fitting according to this invention is distinguished by the fact that the welding surface of the support fitting to the rib is shaped narrower, and by the fact that a single globule of a deoxidizing conductive material used as flux is attached to the narrowed welding surface.

With this embodiment of the invention, even though the shape of the support fitting is long and narrow, the fact that its welding surface is narrowed makes it easier to achieve uniform contact with the base metal and increases the contact pressure on the welding surface. And because the deoxidizing conductive material used as flux is stuck to the constricted welding surface in a single globule, the arc can be started from the globule so that there is no possibility of a lopsided weld.

Because the constricted area is fused in its current state during arc stud welding, there is no possibility that this portion will be undercut. In other words, the surface should be constricted so that it cannot be undercut.

Because the welding surface is constricted, the fused portion will not extend very much beyond the periphery of the support fitting. Thus the ferrule placed on that periphery will not become trapped in the molten metal.

This invention, then, makes it possible to use arc stud welding using a ferrule easily and reliably without sacrificing the function of the support fitting.

In another preferred embodiment of this invention, if the support fitting is a vertical piece which extends a fixed distance perpendicular from the rib, the first upper surface of the perpendicular support fitting, which supports the ferrule, is kept horizontal, and the second upper surface of the perpendicular support fitting, which engages with the heat-resistant block on its end, is angled slightly upwards. The first upper surface is provided with a horizontal portion which can tightly engage with the ferrule for arc stud welding.

With this configuration, when the support fitting 100 is arc stud welded to the base metal, the first upper surface of the support fitting which supports ferrule 20 makes a right angle (i.e., it is horizontal) with respect to the welding surface of the base metal. This results in the ferrule also supported parallel to the welding surface of the base metal. In other words, the entire surface of the ferrule is flush against the surface of flat rib 12 (the base metal) without any gap at its lower end. This facilitates maintaining a uniform temperature. The ferrule completely seals the welding surface of the base metal, so it can fulfill its role as a mold.

In yet another preferred embodiment of this invention, the support fitting for the heat-resistant block to protect boiler tubes has a vertical piece which extends a fixed distance perpendicular from the rib, and a catch to engage with the heat-resistant block, which extends upward from the end of the vertical piece.

The invention is distinguished by the fact that the welding surface of the support fitting to the rib is shaped narrower, and a single globule of a deoxidizing conductive material used as flux is attached to the narrowed welding surface, and further by the fact that the vertical piece and the catch engage with each other in double groove style.

With this embodiment, in addition to the effects mentioned above, the support fitting is bifurcated to form a groove in the vertical piece which engages with a similar groove in the catch. This allows even support fittings with complex shapes to be manufactured easily by combining stainless steel plates, and it allows extremely heavy heat-resistant blocks to be locked securely into place.

In yet another preferred embodiment of this invention, the support fitting for the heat-resistant block to protect boiler tubes has a vertical piece which extends a fixed distance perpendicular from the rib, and a catch to engage with the heat-resistant block, which extends upward from the end of the vertical piece.

The invention is distinguished by the fact that the welding surface of the support fitting to the rib is shaped narrower, and a single globule of a deoxidizing conductive material used as flux is attached to the narrowed welding surface, and further by the fact that the vertical piece and the catch are cast from a heat-resistant metal comprising no more than 0.1% C by weight; no more than 2% Si by weight; no more than 2% Mn by weight; no more than 0.045% P by weight; no more than 0.040% S by weight; from 19.00 to 22.00% Ni by weight; and from 23.00 to 27.00% Cr by weight.

With this embodiment, a cast metal can be used which is produced by minimizing the proportion of C in the existing cast stainless steel SCS18. This will maximize the metal's resistance to corrosion and its welding capability, and enable it to be formed into complex shapes.

BRIEF DESCRIPTION OF THE DRAWINGS

FIGS. 4(A) illustrates the combined structure of boiler tubes and heat-resistant assembly;

FIG. 4(B) is a side view of the combined structure of boiler tubes and heat-resistant assembly shown in FIG. 4(A);

FIG. 6 shows the process of the arc stud welding using the ferrule 20 according to the prior art.

DETAILED DESCRIPTION OF THE PREFERRED EMBODIMENTS

Figure 1A:
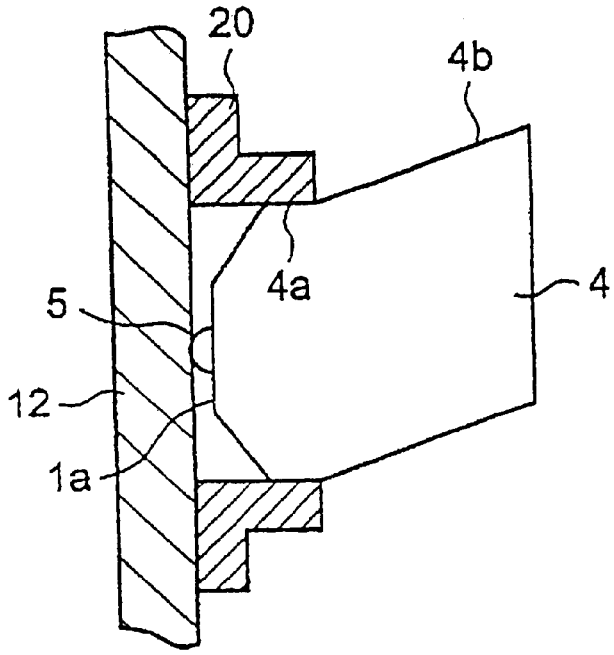
FIG. 1(A) illustrates a support fitting 1 which is related to the first preferred embodiment of this invention and is a cross sectional view showing the appearance of the support fitting with ferrule 20 in place just before the arc stud welding using a ferrule begins.
Figure 1B:
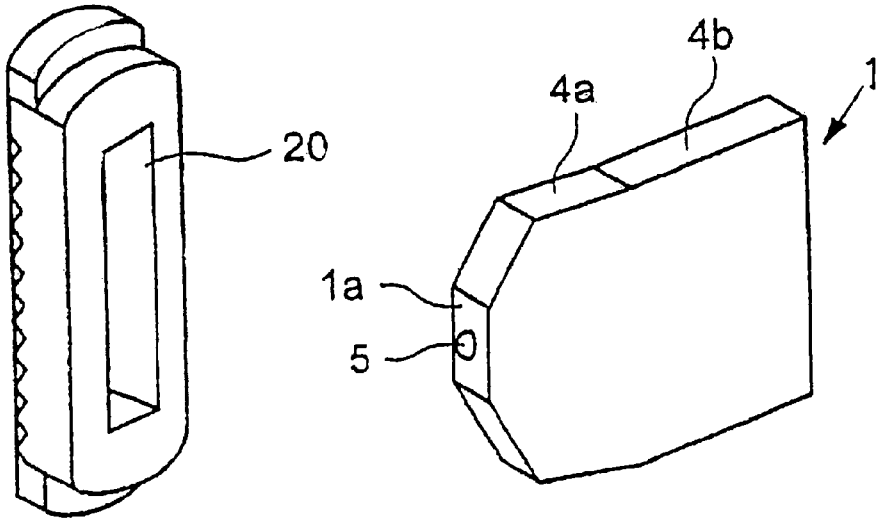
FIG. 1(B) also illustrates the support fitting 1 shown in FIG. 1(A) and is a perspective drawing of ferrule 20 and support fitting 1.

In the following section we shall give a detailed explanation of the invention with reference to the drawings. Insofar as the size, shape, relative position of the components, or other features of the components disclosed in these embodiments, they are not intended to limit the scope of the invention, but serve merely as examples to clarify the explanation unless otherwise there are specific remarks FIG. 1 illustrates a support fitting 1 which is related to the first preferred embodiment of this invention. At the base of the fitting is the welding surface. From a rib surface 12 of boiler tube assembly 10, the fitting projects at a right angle from surface 12. On the end of the fitting is a catch which engages with heat-resistant block 16 so that the block can be interlocked with the boiler tube assembly. Both the upper and lower corners of the welding surface of the support fitting 1 which come in contact with the rib surface 12 are chamfered at a slant to reduce the contact area with the rib surface. A globule of an aluminum deoxidizing conductive material 5 used as flux is attached to the chamfered welding surface 1*a*. If the support fitting 1 is a perpendicular piece 4 which extends at a right angle from the rib, the upper surface of the piece 4 is divided into two surfaces. The upper surface has two different angles, a horizontal surface 4*a* nearest the base where the piece will be welded, and an oblique surface 4*b* which angles upward from surface 4*a*. The length of the horizontal surface 4*a* is chosen so that the ferrule 20 will fit on it.

Here is a brief explanation of the principle of arc stud welding using a ferrule as it would apply to perpendicular piece 4. Ferrule 20 is placed on the end of perpendicular piece 4. The chamfered welding surface 1*a* of piece 4 is placed in direct contact with rib surface 12 (the base metal) with deoxidizing conductive material 5 used as flux between the two surfaces. When the welder pulls the trigger of the welding electrode (not shown), a current flows between the piece 4 and the rib surface 12.

The perpendicular piece 4 is automatically withdrawn a given distance from rib surface 12 by the lifting mechanism of the welding electrode. An arc is generated inside ferrule 20 between welding surface la of piece 4 and rib surface 12. The arc is maintained for a period of time measured by a timer. Perpendicular piece 4 and rib surface 12 fuse. When the given period of time has elapsed, the piece 4 is pushed to rib surface 12, and then the current is cut off.

With this embodiment, then, even if the shape of the support fitting 1 is long and narrow, the fact that the welding surface is chamfered makes it easy to achieve uniform contact between that surface and rib surface 12 (i.e., the base metal) and enables the welder to achieve a high contact pressure on the welding surface la. The fact that deoxidizing conductive material 5 used as flux is stuck onto the chamfered welding surface la in the form of a globule allows the arc to be started from the material 5. This eliminates the possibility for the weld to be uneven.

Because this chamfered welding surface la melts shorter during the stud welding, there is no chance that the chamfered portion will be undercut or have a similar defect. In other words, the corner of perpendicular piece should be chamfered by predetermined length so that it cannot be undercut during the welding.

Because the welding surface la is shortened by chamfer in this way, the molten metal will not extend very far beyond the periphery of support fitting 1. This will prevent the ferrule 20 which is placed around the fitting from becoming trapped in the molten metal.

With this embodiment, ferrule 20 is supported by the horizontal surface 4*a* of perpendicular piece 4 which is at a right angle to the base metal. Since ferrule 20 is also in rigorous contact with the surface of flat rib 12 (i.e., the base metal) to shield the molten metal, a uniform temperature can easily be maintained. The ferrule can also fulfill the function of a mold.

Figure 2:
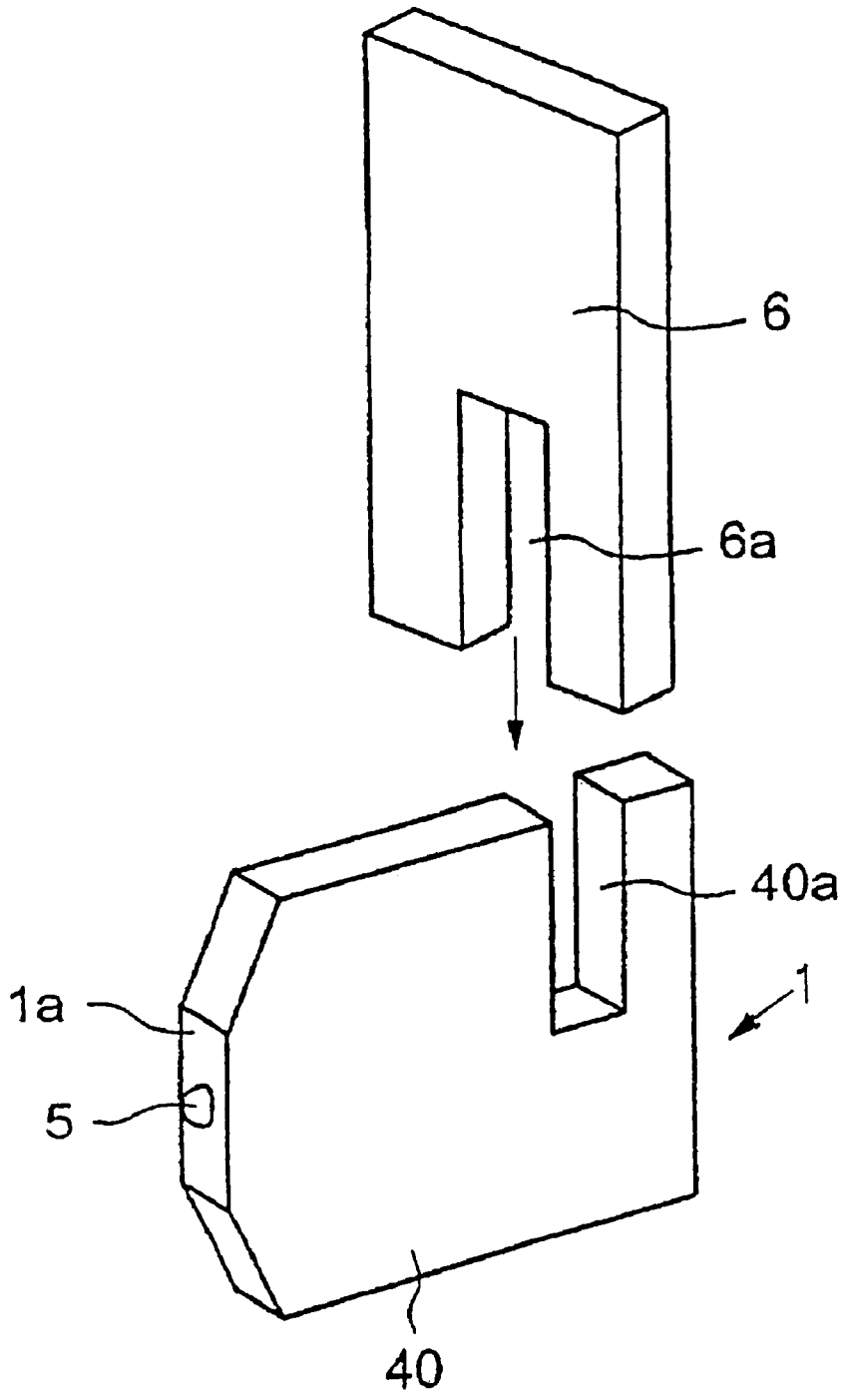
FIG. 2 illustrates a support fitting 1 which is related to the second preferred embodiment of this invention and is an exploded perspective drawing of the vertical piece and its catch.

FIG. 2 relates to the second preferred embodiment of this invention. In this embodiment, the support fitting 1 to attach a heat-resistant block to a boiler tube assembly has a vertical piece 40, which extends perpendicular to rib surface 12 on boiler tube assembly 10 with a welding surface between the piece and the rib; and a catch 6 for holding heat-resistant block 16, which extends upward from the front end of the vertical piece.

The upper surface of the perpendicular piece 40 of this embodiment forms a horizontal rectangle. Both the upper and lower corners of the welding surface of the piece, the surface which comes in contact with the surface of the rib 12, are chamfered at a slant to make a chamfered welding surface 1*a*. The deoxidizing conductive material 5 used as flux is stuck onto the chamfered welding surface la in the form of a globule. Another end of the upper surface of the perpendicular piece 40 has a rectangular groove 40*a* cut into it which interlocks with a similar groove in catch 6.

Catch 6 is also rectangular. It has a groove 6*a* on its lower surface which engages with the groove 40*a* on the upper surface of the perpendicular piece 40.

After the perpendicular piece 40 is welded to the rib by arc stud welding using a ferrule, the piece 40 and catch 6 are fitted together by interlocking their respective grooves 40*a* and 6*a*.

With this embodiment, the fitting can easily be welded by using an arc stud welding technique. Realizing support fitting 1 as two discrete pieces with grooved surfaces which interlock with each other allows even a-fitting with a complicated shape to be manufactured easily from pieces of stainless steel. Such a fitting will secure the attachment of a heat-resistant block 16 which is quite heavy.

Figure 3:
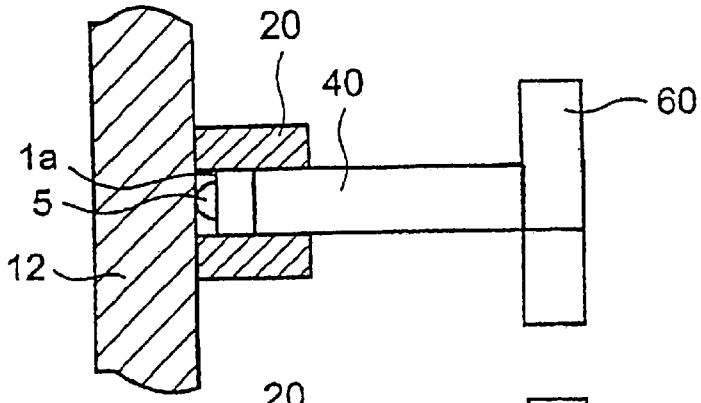
FIG. 3(A) illustrates a support fitting 1 which is related to the third preferred embodiment of this invention and is a plain view showing the appearance of the fitting with the ferrule 20 in place just before the arc stud welding begins.
FIG. 3(B) is a side view of the support fitting shown in FIG. 3(A)
FIG. 3(C) is a perspective drawing of the ferrule 20 and the support fitting 1 shown in FIG. 3(A)
Figure 3:
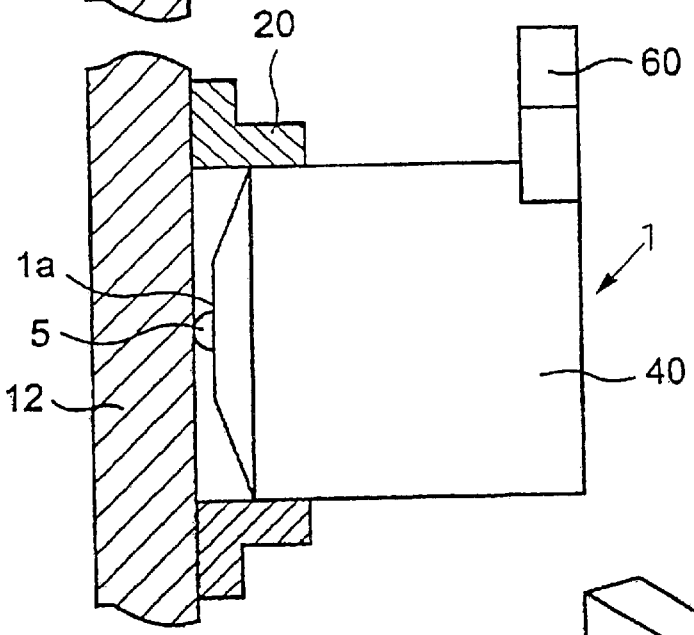
Figure 3:
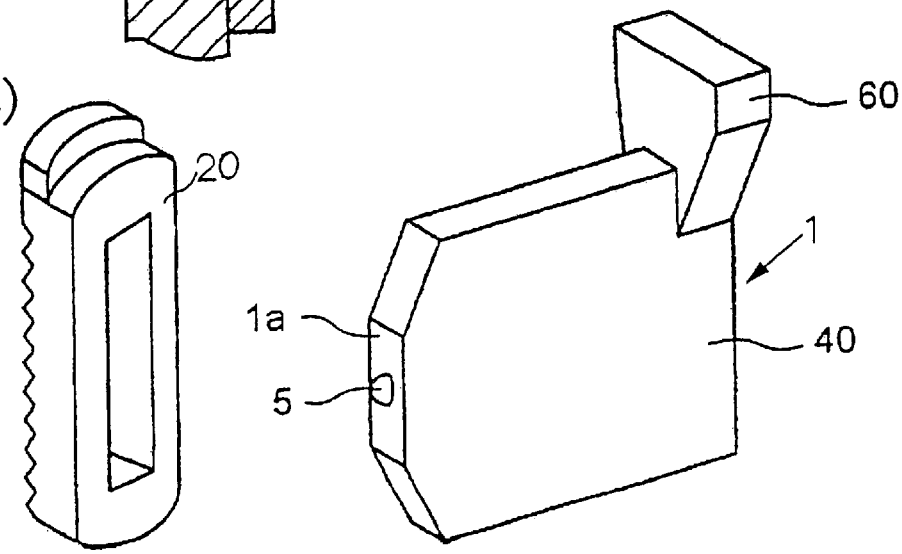
Figure 5:
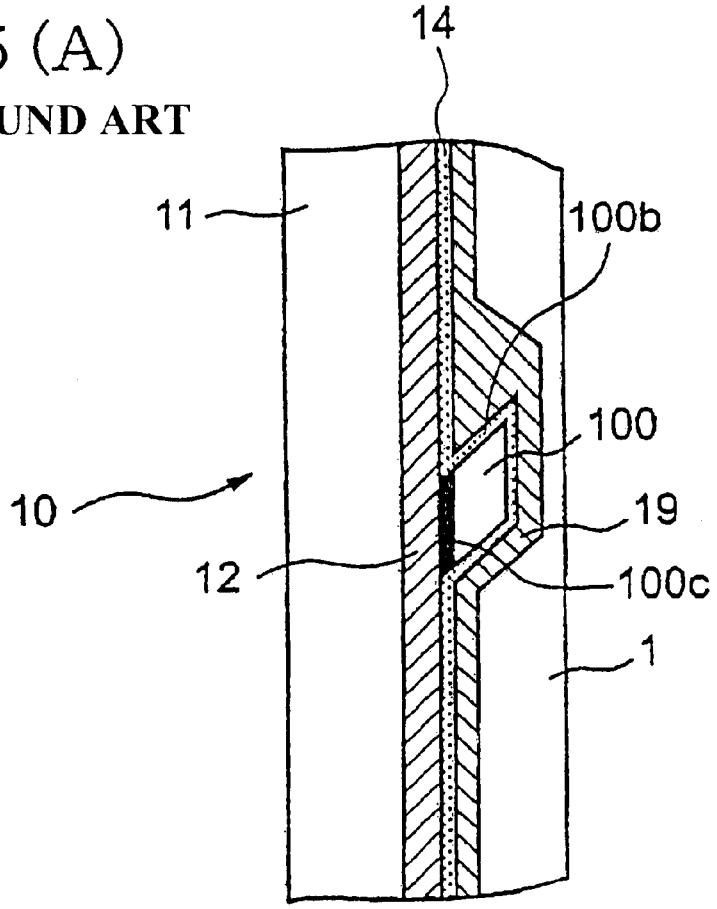
Fig. 5 (A) BACKGROUND ART
FIG. 5(A) illustrates a vertical cross sectional view of the combined structure of boiler tubes and heat-resistant assembly which relates to the prior art.
FIG. 5(B) is a cross sectional view showing the appearance of the fitting with ferrule 20 in place just before the arc stud welding begins.
Figure 5:
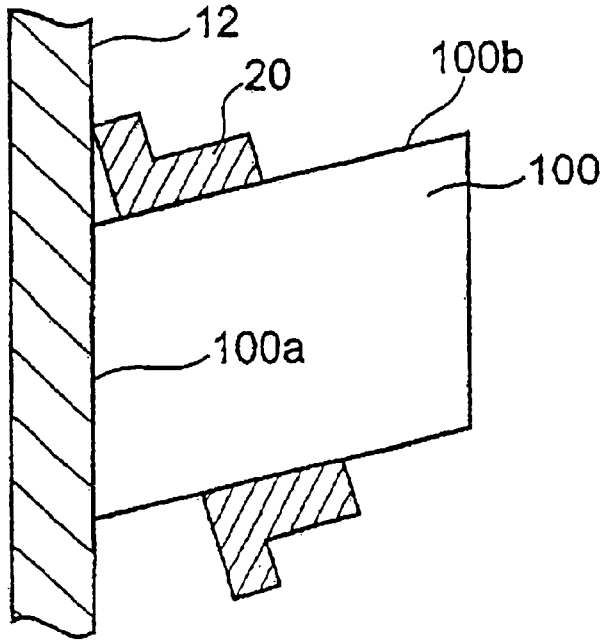
Fig. 5 (B) BACKGROUND ART

FIG. 3 shows a support fitting 1 which relates to the third preferred embodiment of this invention. (A) is a cross section of the fitting with ferrule 20 in place just before arc stud welding. (B) is a side view. (C) is a perspective drawing of ferrule 20 and support fitting 1.

The upper surface of the perpendicular piece 40 which comes in contact with the surface of the rib 12 has the shape of a horizontal rectangle. The upper and lower portions of its welding surface are chamfered to reduce the area to be welded. Deoxidizing conductive material 5 used as flux is stuck onto the chamfered welding surface 1*a* in the form of a globule. Catch 60, a roughly V-shaped tongue on the top of the front end of piece 40, increases in width as it extends upward.

The perpendicular piece 40 and catch 60 may be molded as a single piece. If the piece 40 and the catch 60 are made of a heat-resistant cast metal comprising no more than 0.1% C by weight; no more than 2% Si by weight; no more than 2% Mn by weight; no more than 0.045% P by weight; no more than 0.040% S by weight; from 19 to 22% Ni by weight; and from 23 to 27% Cr by weight, they can be welded by arc stud welding without having to use ferrule 20. If this composition were used, percussion stud welding would be an appropriate technique.

Arc stud welding using a ferrule differs from percussion stud welding for the following reason. In percussion, the chamfered welding surface 1*a* of perpendicular piece 40 is brought into direct contact with the surface of rib 12 (i.e., the base metal) with deoxidizing conductive material 5 used as flux between the two, however, the welder then pulls the trigger of the welding electrode (not pictured), and the piece and the rib 12 can remain in contact until the welding is completed.

In this embodiment, a cast metal is used which is produced by minimizing the proportion of C in the existing cast stainless steel SCS18. This maximizes the metal's resistance to corrosion and its welding capability, and enables it to be formed into complex shapes. A support fitting 1 can thus be made with a shape that is best suited to interlock with heat-resistant block 16.

As discussed above, with this invention a support fitting can be arc stud-welded using a ferrule easily and reliably without sacrificing any of its capability. More specifically, this invention allows a support fitting to be formed which is ideally suited to interlock with a heat-resistant block.

What is claimed is:

1. A support fitting for a heat-resistant block to protect boiler tubes, which protrudes upward at a right angle from a surface of a rib provided between two boiler tubes, and which is welded on the rib, said support fitting comprising:

a substantially parallelepiped body having a welding surface portion configured to be welded on the rib and narrowed by chamfering; and a globule flux of a deoxidizing conductive material attached to said welding surface, wherein said substantially parallelepiped body comprises a first portion configured to engage with a ferrule for arc stud welding and a second portion configured to engage with the heat-resistant block.

2. A support fitting according to claim 1, further comprising a catch configured to interlock with said second portion in double groove fashion and engage with the heat-resistant block.

3. A support fitting according to claim 2, wherein said substantially parallelepiped body and said catch are cast from a heat-resistant metal comprising no more than 0.1% C by weight; no more than 2% Si by weight; no more than 2% Mn by weight; no more than 0.045% P by weight; no more than 0.040% S by weight; from 19.00 to 22.00% Ni by weight; and from 23.00 to 27.00% Cr by weight.

4. A support fitting according to claim 3, wherein said catch comprises a substantially flat body configured to perpendicularly engage with said substantially parallelepiped body such that the substantially flat body is parallel to the rib.

5. A support fitting according to claim 1, wherein said second portion of the substantially parallelepiped body is slightly angled with respect to the first portion of the substantially parallelepiped body.

* * * * *